US008802229B2

(12) United States Patent
Luo

(10) Patent No.: US 8,802,229 B2
(45) Date of Patent: Aug. 12, 2014

(54) LYOCELL FIBERS

(75) Inventor: Mengkui Luo, Auburn, WA (US)

(73) Assignee: Weyerhaeuser NR Company, Federal Way, WA (US)

( * ) Notice: Subject to any disclaimer, the term of this patent is extended or adjusted under 35 U.S.C. 154(b) by 411 days.

(21) Appl. No.: 11/771,837

(22) Filed: Jun. 29, 2007

(65) Prior Publication Data

US 2009/0004473 A1 Jan. 1, 2009

(51) Int. Cl.
*D02G 3/00* (2006.01)
*D04H 1/56* (2006.01)

(52) U.S. Cl.
USPC ..... 428/372; 428/364; 442/400

(58) Field of Classification Search
USPC ..... 442/400; 428/364, 372
See application file for complete search history.

(56) References Cited

U.S. PATENT DOCUMENTS 3,912,673 A 10/1975 Force
4,619,703 A 10/1986 Gerber
4,970,241 A * 11/1990 Kowalski et al. ..... 521/57
5,609,957 A * 3/1997 Page et al. ..... 428/372
5,743,949 A * 4/1998 Kainz ..... 106/271
6,210,801 B1 4/2001 Luo
6,245,837 B1 * 6/2001 Cassel et al. ..... 524/35
6,258,304 B1 7/2001 Bahia
6,306,334 B1 * 10/2001 Luo et al. ..... 264/561
2006/0069209 A1 * 3/2006 Klosiewicz ..... 525/242

FOREIGN PATENT DOCUMENTS

EP 1618925 7/2004
GB 2121069 A * 12/1983

OTHER PUBLICATIONS

Lewandowski Z, "Application of a linear synthetic polymer to improve the properties of cellulose fibers made by the NMMO process," *J Appl Polymer Sys Sci* 83: 2762-2773 (2002).

* cited by examiner

*Primary Examiner* — Jeremy R Pierce
(74) *Attorney, Agent, or Firm* — Weyerhaeuser Law Dept.; Timothy M. Whalen

(57) ABSTRACT

Meltblown lyocell fibers incorporating polyolefinic hydrophobic polymers are disclosed. The polymer is distributed fairly uniformly within the fiber and exists as approximately one to two micron diameter domains. The fibers have a high hemicellulose level, show reduced water retention values and have varying diameters depending on processing conditions. The fibers have a brightness of at least 60.

9 Claims, 5 Drawing Sheets

LYOCELL FIBERS

FIELD

The present application relates to meltblown lyocell fibers incorporating polyolefinic hydrophobic polymers.

DETAILED DESCRIPTION

Figure 1:
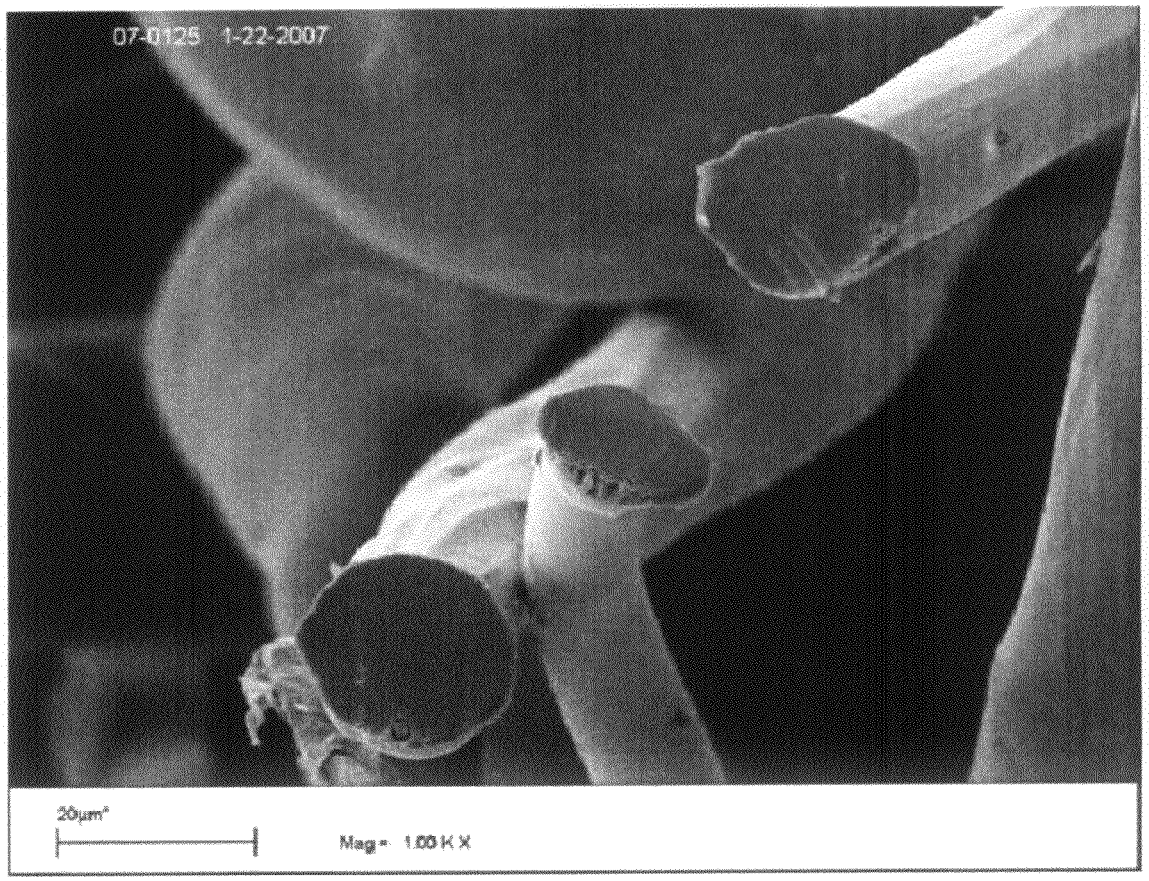
FIG. 1 is a scanning electron photomicrograph at 1000× of the longitudinal and cross section of control Sample A.

The present application is directed to lyocell fibers comprising at least one hydrophobic component.

Current lyocell manufacturing practices are limited in throughput of cellulose due to the viscosity of the cellulose needed for specific end use performance. This limitation dictates additional spinning equipment requirements and consequently higher capital costs. A lower viscosity of the spinning dope is needed without reducing the cellulose D.P. and consequently the viscosity of the cellulose. As defined herein, degree of polymerization (abbreviated D.P.) refers to the number of anhydro-D-glucose units in the cellulose chain. D. P. was determined by ASTM Test 1795-96.

It has now been found that addition of a polyethylene polymer as an additive to the spinning solution of a lyocell dope results in a significant reduction in dope viscosity, easier spinning and the same throughput of cellulose per unit time than without the additive. As a result, there is a higher total solids throughput. It is contemplated that the higher throughput is due to the lower viscosity in the spinning solution. A secondary benefit of the addition of the polyethylene polymer is that a lyocell fiber with both hydrophilic and hydrophobic characteristics is a resultant product. Such a fiber could find applications in areas such as acquisition and distribution layers in anhygenic product, wound and burn care dressings, medical wipes, air and water filters, wipes and towels.

The polyolefinic polymer has a weight average molecular weight of 50,000 or less.

Lyocell fibers are particularly suitable for use in nonwoven applications because of their characteristic soft feel, water absorbtion, microdiameter size, biodegradability and the ability of these fibers to be combined in the spinning process to form either selfbonded or spunlaced webs. Fibers made from pulp with a high hemicellulose content are particularly suited for this application because of the added interfiber bonding attributed to hemicellulose.

Currently available lyocell fibers are produced from high quality wood pulps that have been extensively processed to remove non-cellulose components, especially hemicellulose. These highly processed pulps are referred to as dissolving grade or high a (high alpha) pulps, where the term a refers to the percentage of cellulose remaining after extraction with 17.5% caustic. Alpha cellulose can be determined by TAPPI 203. Thus, a high alpha pulp contains a high percentage of cellulose, and a correspondingly low percentage of other components, especially hemicellulose. The processing required to generate a high alpha pulp significantly adds to the cost of lyocell fibers and products manufactured therefrom. Typically, the cellulose for these high alpha pulps comes from both hardwoods and softwoods; softwoods generally have longer fibers than hardwoods.

Since conventional Kraft processes stabilize residual hemicelluloses against further alkaline attack, it is not possible to obtain acceptable quality dissolving pulps, i.e., high alpha pulps, through subsequent treatment of Kraft pulp in the bleaching stages. A relatively low copper number, reflective of the relative carbonyl content of the cellulose, is a desirable property of a pulp that is to be used to make lyocell fibers because it is generally believed that a high copper number causes cellulose and solvent degradation, before, during, and/or after dissolution in an amine oxide solvent. The degraded solvent can either be disposed of or regenerated, however, due to its cost it is generally undesirable to dispose of the solvent.

A low transition metal content is a desirable property of a pulp that is to be used to make lyocell fibers because, for example, transition metals accelerate the undesirable degradation of cellulose and NMMO in the lyocell process.

In view of the expense of producing commercial dissolving grade pulps, it is desirable to have alternatives to conventional high alpha dissolving grade pulps as a lyocell raw material.

Low alpha (e.g., high yield) pulps can be used to make lyocell fibers. Preferably, the desired low alpha pulps will have a low copper number, a low lignin content and a desirably low transition metal content but broad molecular weight distribution.

Pulps which meet these requirements have been made and are described in U.S. Pat. Nos. 6,797,113, 6,686,093 and 6,706,876, the assignee of the present application. While high purity pulps are also suitable for use in the present application, low cost pulps such as Peach®, Grand Prairie Softwood and C-Pine, all available from Weyerhaeuser are suitable. These pulps provide the benefit of lower cost and better bonding for nonwoven textile applications because of their high hemicellulose content. Selected pulp properties are given in Table 1.

TABLE 1

| Pulp Properties | | | | | |
|---|---|---|---|---|---|
| Pulp | $R_{10}$ | $R_{18}$ | % Xylan | % Mannan | α-cellulose |
| Peach | 85 | 88 | 7.05 | 6.10 | 86 |
| Grand Prairie Softwood | | 19* | 7.59 | 6.2 | |
| C-Pine | 87.4 | 88.0 | 7.50 | 5.86 | |

*18% solubitity by TAPPI T235

The degraded shorter molecular weight components in the pulp are measured by the $R_{18}$ and $R_{10}$ content as described in TAPPI 235. $R_{10}$ represents the residual undissolved material that is left extraction of the pulp with 10 percent by weight caustic and $R_{18}$ represents the residual amount of undissolved material left after extraction of the pulp with an 18% caustic solution. Generally, in a 10% caustic solution, hemicellulose and chemically degraded short chain cellulose are dissolved and removed in solution. In contrast, generally only hemicellulose is dissolved and removed in an 18% caustic solution. Thus, the difference between the $R_{10}$ value and the $R_{18}$ value, ($\Delta R = R_{18} - R_{10}$), represents the amount of chemically degraded short chained cellulose that is present in the pulp sample. In one embodiment the pulp has a $\Delta R$ from about 2 to a $\Delta R$ of about 10. In another embodiment the $\Delta R$ is from about 4 to a $\Delta R$ of about 6.

The term hemicellulose refers to a heterogeneous group of low molecular weight carbohydrate polymers that are associated with cellulose in wood. Hemicelluloses are amorphous, branched polymers, in contrast to cellulose which is a linear polymer. The principal, simple sugars that combine to form hemicelluloses are: D-glucose, D-xylose, D-mannose, L-arabinose, D-galactose, D-glucuronic acid and D-galacturonic acid.

Hemicellulose was measured in the pulp and in the fiber by the method described below for sugar analysis and represents the sum of the xylan and mannan content of the pulp or fiber.

Polyethylene with a melting point 90° C., a softening point of 104° C., a number average (Mn) by GPC of 7700, weight average by GPC of 35,000, melt index (190° C., 2.16 kg) of 2.25 kg/10 min, a viscosity of 78 poise and an acid number of <0.05 mg KOH/g was obtained from Aldrich. Other additives such as modified polyethylene, paraffin waxes, low molecular weight polypropylene, and modified polypropylene are also suitable additives.

In one embodiment the additive has an acid number of <8 mg KOH/g. In another embodiment the additive has an acid number of <5 mg KOH/g. In another embodiment the additive has an acid number of <1 mg KOH/g.

In the case of polyethylene, the additive was added at levels of from 9.6 to 28.8 percent by weight on cellulose in the NMMO. In one embodiment the additive is added at a level of from 0.5 to 35 percent by weight on cellulose. In another embodiment the additive is added at a level of from 5 to 20 percent by weight on cellulose. In yet another embodiment the additive is added at a level of from 10 to 15 percent by weight on cellulose.

Meltblown fibers made with polyethylene as the additive are shown in Table 2.

The starting D. P. of the pulp can range from 200 to 2000, from 350 to 900 and from 400 to 800.

Lyocell fibers prepared with the additive can be spun by various processes. In one embodiment the lyocell fiber is spun from cellulose dissolved in NMMO by the meltblown process. Where the term meltblown is used it will be understood that it refers to a process that is similar or analogous to the process used for the production of thermoplastic fibers, event though the cellulose is in solution and the spinning temperature is only moderately elevated. In another embodiment the fiber is spun by the centrifugal spinning process, in another embodiment the fiber is spun by the dry-jet-wet process and in yet another embodiment the fiber is spun by the spunbonding process. Fibers formed by the meltblown process can be continuous or discontinuous depending on air velocity, air pressure, air temperature, viscosity of the solution, D.P. of the cellulose and combinations thereof; in the continuous process the fibers are taken up by a reel and optionally stretched. In one embodiment for making a nonwoven web the fibers are contacted with a non solvent such as water by spraying, subsequently taken up on a moving foraminous support, washed and dried. The fibers formed by this method can be in a bonded nonwoven web depending on the extent of coagulation or if it is spunlaced. Spunlacing involves impingement with a water jet. A somewhat similar process is called "spunbonding" where the fiber is extruded into a tube and stretched by an air flow through the tube caused by a vacuum at the distal end. In general, spunbonded fibers are longer than meltblown fibers which usually come in discrete shorter lengths. Another process, termed "centrifugal spinning", differs in that the polymer is expelled from apertures in the sidewalls of a rapidly spinning drum. The fibers are stretched somewhat by air resistance as the drum rotates. However, there is not usually a strong air stream present as in meltblowing. The other technique is dry jet/wet. In this process the filaments exiting the spinneret orifices pass through an air gap before being submerged and coagulated in a liquid bath. All four processes may be used to make nonwoven fabrics.

In one embodiment the fibers are made from a pulp with greater than three percent by weight hemicellulose. In another embodiment the fibers are made from a pulp with greater than eight percent by weight hemicellulose. In yet another embodiment the fibers are made from a pulp with greater than twelve percent by weight hemicellulose.

In one embodiment the fibers contain from about 4.0 to 18% by weight hemicellulose as defined by the sum of the xylan and mannan content of the fibers. Sugar analysis was performed by the method described below. In another embodiment the fibers contains from 7 to 14% by weight hemicellulose and in yet another embodiment the fibers contain from 9% to 12 percent by weight hemicellulose.

In one embodiment the D.P. of the fibers is from about 200 to 2000. In another embodiment the D.P is from about 350 to about 900 and in yet another embodiment the D.P. is from about 400 to about 800.

Figure 2:
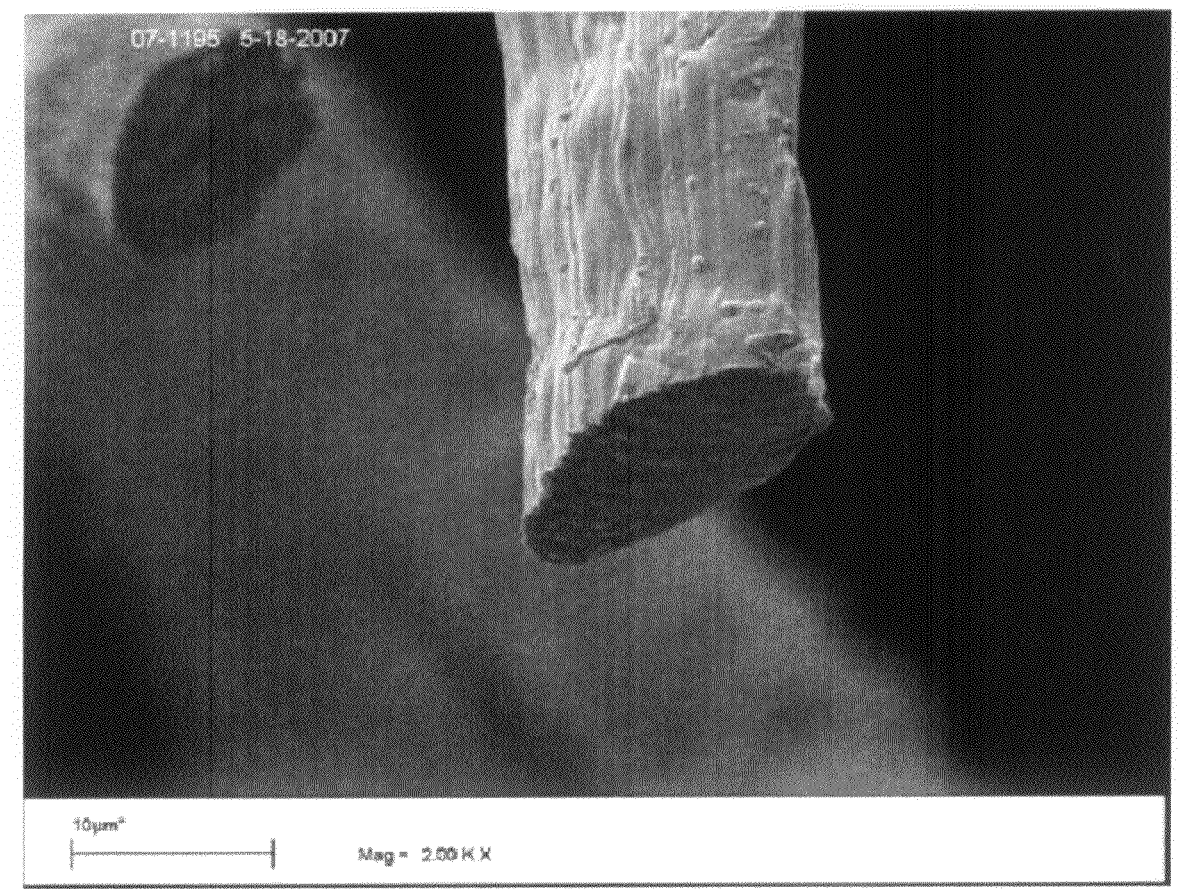
FIG. 2 is a scanning electron photomicrograph at 2000× of the longitudinal and cross section of Sample 7.
Figure 3:
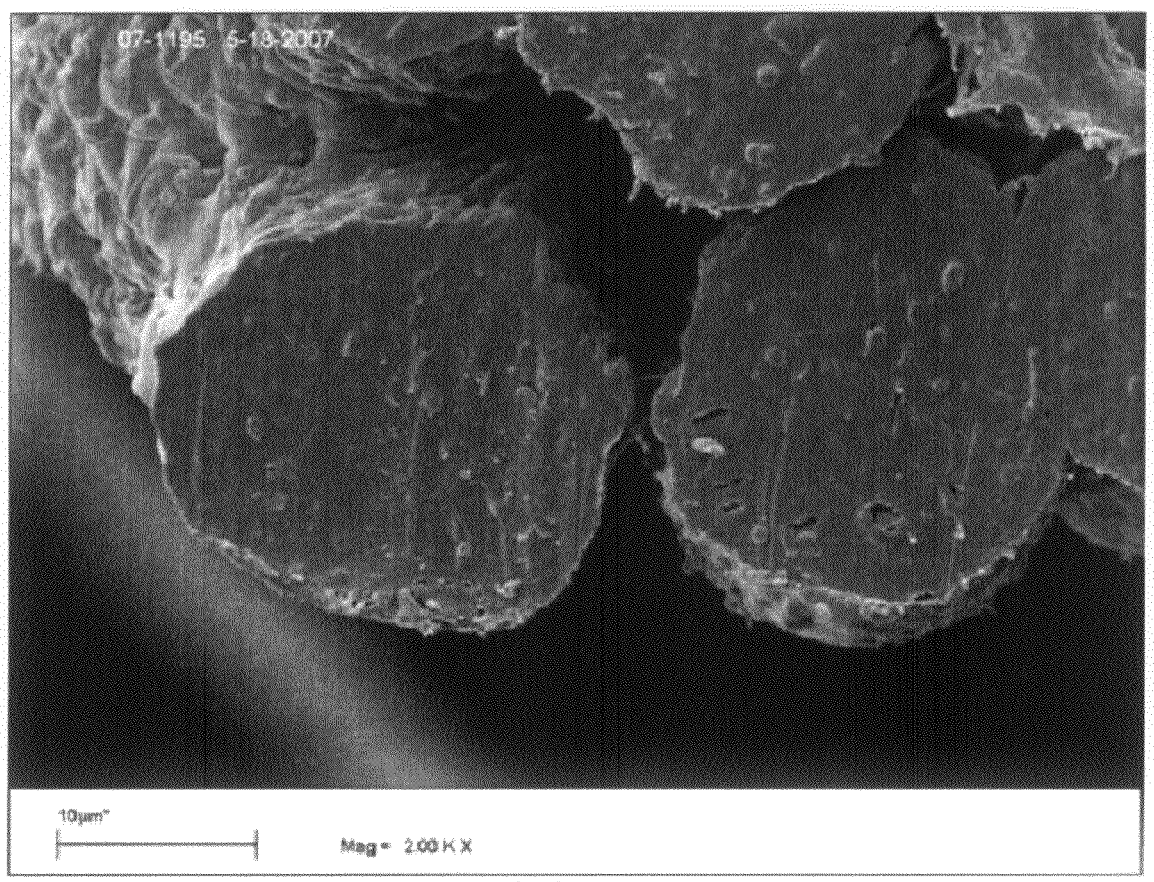
FIG. 3 is a scanning electron photomicrograph at 2000× of the longitudinal and cross section of Sample 5.
Figure 4:
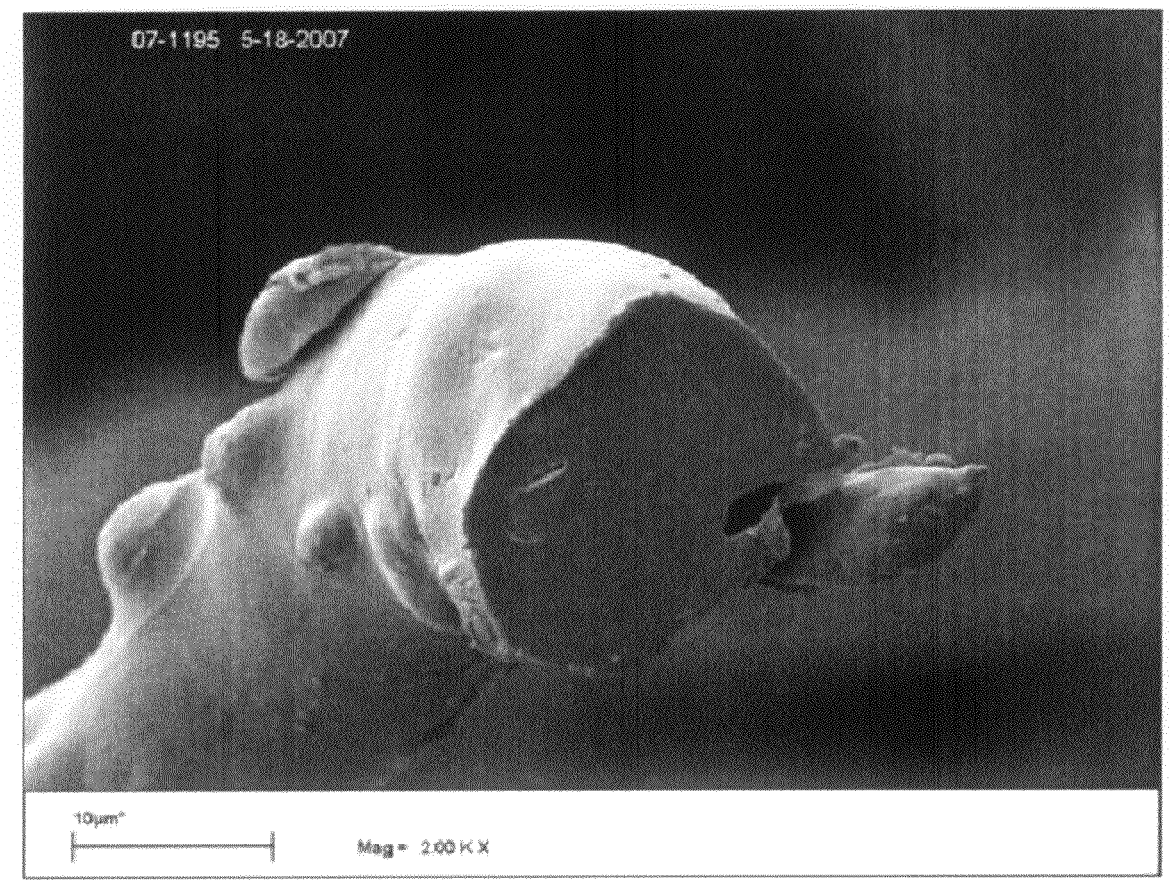
FIG. 4 is a scanning electron photomicrograph at 2000× of the longitudinal and cross section of Sample 6.
Figure 5:
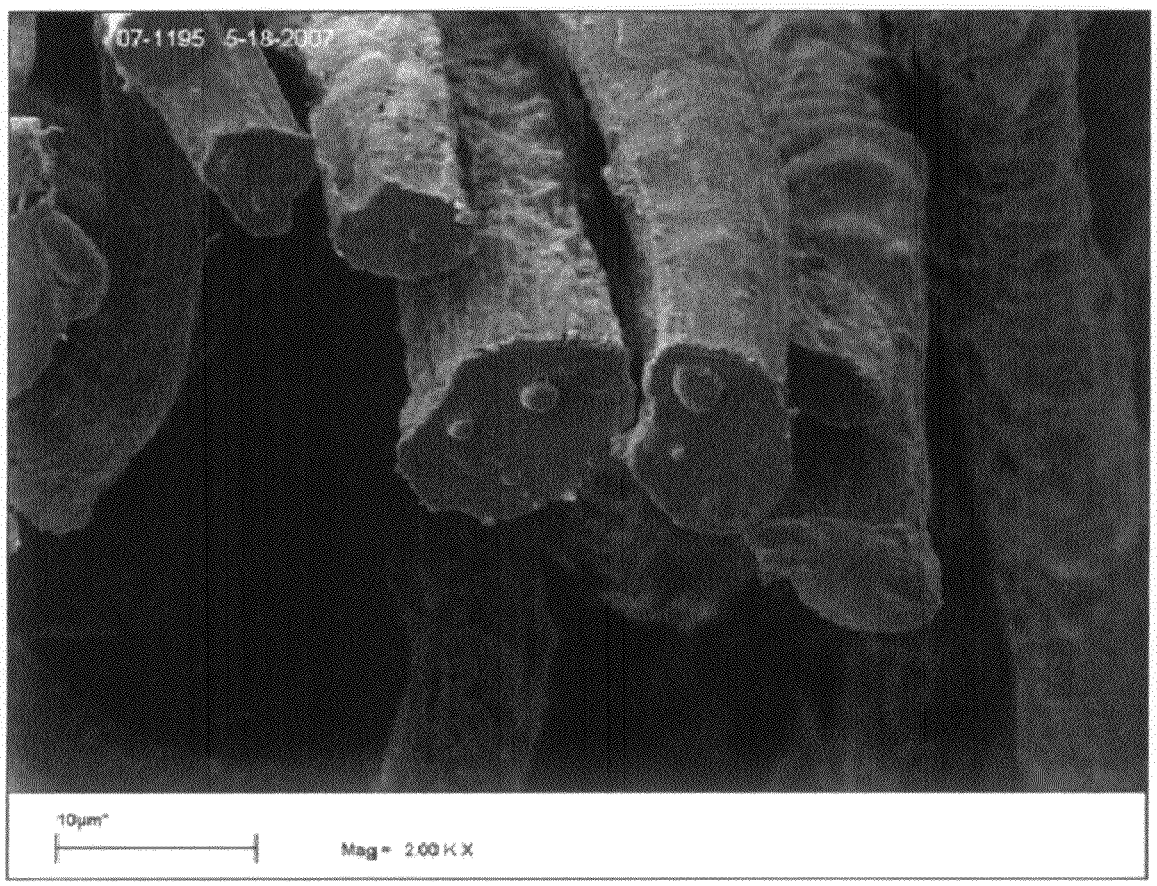
FIG. 5 is a scanning electron photomicrograph at 2000× of the longitudinal and cross section of Sample 8.

Meltblown fibers incorporating the polyethylene additive are shown in FIGS. 2-5. FIG. 1 is a scanning electron photomicrograph (SEM) of a control sample showing a longitudinal section and cross section of the fibers at 1000×. The fibers are relatively smooth with oblong to circular cross sections. FIG. 2 is a SEM at 1000× of the longitudinal and cross section of Sample 7 showing longitudinal wavy striations on the surface and one to two micron sized nodular-like protrusions on the surface. The average fiber diameter of this sample is 14.3 microns. FIG. 3 is a SEM at 2000× of Sample 5 again showing the wavy striations on the surface and one to two micron sized polyethylene domains in the cross section; the average fiber diameter is 14.1 microns. The nodular protrusions on the surface of the fiber containing polyethylene are shown in FIG. 4 which is a SEM of the fiber at 2000×. FIG. 5 is a SEM at 2000× of a cross section of Sample 8 showing polyethylene domains of one to two microns. Meltblown fibers made with the polyethylene additive have a random and fairly uniform distribution of the polyethylene domains.

It is contemplated that meltdown fibers of the present application can contribute to bulk in various end use applications such as hygienic products and could be made with various degrees of hydrophilic/hydrophobic properties.

Depending on a number of factors such as air velocity, air pressure, air temperature, viscosity of the solution, D.P. of the cellulose and combinations thereof, a wide range of fiber properties can be obtained by the meltblowing process. In one embodiment the fibers have a fiber diameter of from about 5μ to about 50μ. In another embodiment the fibers have a fiber diameter of from about 10μ to about 30μ and in yet another embodiment the fibers have a fiber diameter of from about 15 to about 20μ. Fiber diameter measurements represent the average diameter of 100 randomly selected fibers and measurement with a light microscope.

Water retention values, an indication of the hydrophobicity of the fiber were reduced by at least 10 percent from the control. In one embodiment the water retention value was reduced by at least 5 percent from a control. In another embodiment the water retention value was reduced by at least 20 percent from a control. In yet another embodiment the water retention value was reduced by at least 30 percent from a control. Water retention values were determined by TAPPI T-UM256.

Birefringence of the fibers indicates a high degree of molecular orientation of the cellulose fibers which is virtually unchanged from the control. Control value ranged from 0.026 to 0.034 and samples with the polyethylene additive ranged from 0.024 to 0.03. This suggests that in spite of the additive, the molecular orientation is not adversely affected. Birefringence was determined by the method described below.

Brightness values decreased slightly from the control. In one embodiment the brightness was at least 60. Brightness was determined by TAPPI T452. Lyocell fibers were used to make a pad by the following procedure: 1.5 oven dry grams fiber were cut into approximately 6 mm lengths and placed in a beaker with water. The fiber was soaked for 30 minutes before making pads with the standard procedure for handsheets. The pads were pressed for 2 minutes and then placed in a controlled humidity room to dry overnight before taking brightness readings.

EXAMPLE

In a representative example, Peach®, a bleached kraft southern pine pulp, available from Weyerhaeuser, Federal Way, Wash., was acid hydrolyzed and treated with sodium borohydride to yield a pulp having an average degree of polymerization of about 420, a hemicellulose content of 12.0% by weight hemicellulose in pulp (6.5% and 5.5% by weight xylan and mannan, respectively) and an $R_{10}$ and $R_{18}$, of about 77 and 87, respectively. The pulp was dissolved in NMMO (N-methyl morpholine N-oxide) as follows. A 250 mL three necked flask was charged with, for example, 66.4 g of 97% NMMO, 24.7 g of 50% NMMO, 0.1 g of propyl gallate, and 1 to 3 g of polyethylene. The flask was immersed in an oil bath at 120° C., a stirrer inserted and stirring continued for about 1 hr. A readily flowable dope resulted that was suitable for spinning. The cellulose concentration in the dope was about 9.9 percent by weight. The dope was extruded from a melt blowing die that had 3 nozzles having an orifice diameter of 457 microns at a rate of 1.0 gram/hole/minute. The orifices had a length/diameter ratio of 5. The nozzle was maintained at a temperature of 95° C. The dope was extruded into an air gap 30 cm long before coagulation in water and collected on a screen as either continuous filaments or discontinuous fibers. Air, at a temperature of 95° C. and a pressure of about 10 psi, was supplied to the head. Samples 1-8 were made with polyethylene as the additive. Variation in fiber diameter was obtained by varying the air pressure from 5 to 30 psi.

Birefringence of Fibers by Polarized Light Microscopy

In theory, fibers can be characterized as having an index of refraction parallel (axial) to the fiber axis and an index of refraction which is perpendicular to the fiber axis. The birefringence for purposes of this method is the difference between these two refractive indices. The convention is to subtract the perpendicular R.I. (refractive index) from the axial R.I. The axial R.I. is typically represented by the Greek letter ω, and the perpendicular index by the letter ϵ. The birefringence is typically represented as $\Delta=(\omega-\epsilon)$.

Refractive Index Oils

Oils are manufactured with known refractive index at a given wavelength of exciting light and at a given temperature. The fibers were compared to Cargile refractive index oils.

Polarized Light

Using transmitted light in the light microscope, the refractive index is measured using a polarizing filter. When the exciting light is polarized in a direction parallel to the axis of the fiber the axial refractive index can be measured. Then the polarizing filter can be rotated 90 degrees and the refractive index measured perpendicular to the fiber axis.

Measurement Using the Light Microscope

When the refractive index of the fiber matches the refractive index of the oil in which it is mounted, the image of the fiber will disappear. Conversely, when the fiber is mounted in an oil which greatly differs in refractive index, the image of the fiber is viewed with high contrast.

When the R.I. of the fiber is close to the R.I. of the oil, a technique is used to determine whether the fiber is higher or lower in refractive index. First the fiber, illuminated with the appropriately positioned polarizing filter, is brought into sharp focus in the microscope using the stage control. Then the stage is raised upward slightly. If the image of the fiber appears brighter as the stage is raised, the fiber is higher in refractive index than the oil. Conversely if the fiber appears darker as the stage is raised, the fiber is lower in refractive index than the oil.

Fibers are mounted in R.I. oils and examined until a satisfactory match in refractive index is obtained. Both the axial and the perpendicular component are determined and the birefringence is calculated.

Sugar Analysis

This method is applicable for the preparation and analysis of pulp and wood Samples for the determination of the amounts of the following pulp sugars: fucose, arabinose, galactose, rhamnose, glucose, xylose and mannose using high performance anion exchange chromatography and pulsed amperometric detection (HPAEC/PAD).

Summary of Method

Polymers of pulp sugars are converted to monomers by hydrolysis using sulfuric acid.

Samples are ground, weighed, hydrolyzed, diluted to 200-mL final volume, filtered, diluted again (1.0 mL+8.0 mL $H_2O$) in preparation for analysis by HPAEC/PAD.

Sampling, Sample Handling and Preservation

Wet Samples are air-dried or oven-dried at 25±5° C.

Equipment Required

Autoclave, Market Forge, Model # STM-E, Serial # C-1808

100×10 mL Polyvials, septa, caps, Dionex Cat # 55058

Gyrotory Water-Bath Shaker, Model G76 or some equivalent.

Balance capable of weighing to ±0.01 mg, such as Mettler HL52 Analytical Balance.

Intermediate Thomas-Wiley Laboratory Mill, 40 mesh screen.

NAC 1506 vacuum oven or equivalent.

0.45-μ GHP filters, Gelman type A/E, (4,7-cm glass fiber filter discs, without organic binder)

Heavy-walled test tubes with pouring lip, 2.5×20 cm.

Comply SteriGage Steam Chemical Integrator

GP 50 Dionex metal-free gradient pump with four solvent inlets

Dionex ED 40 pulsed amperometric detector with gold working electrode and solid state reference electrode Dionex autoSampler AS 50 with a thermal compartment containing the columns; the ED 40 cell and the injector loop Dionex PC10 Pneumatic Solvent Addition apparatus with 1-L plastic bottle 3 2-L Dionex polyethylene solvent bottles with solvent outlet and helium gas inlet caps CarboPac PA1 (Dionex P/N 035391) ion-exchange column, 4 mm×250 mm CarboPac PA1 guard column (Dionex P/N 043096), 4 mm×50 mm Millipore solvent filtration apparatus with Type HA 0.45 u filters or equivalent Reagents Required All references to $H_2O$ is Millipore $H_2O$ 72% Sulfuric Acid Solution (H2SO4)—Transfer 183 mL of water into a 2-L Erlenmeyer flask. Pack the flask in ice in a Rubbermaid tub in a hood and allow the flask to cool. Slowly and cautiously pour, with swirling, 470 mL of 96.6% $H_2SO_4$ into the flask. Allow solution to cool. Carefully transfer into the bottle holding 5-mL dispenser. Set dispenser for 1 mL.

JT Baker 50% sodium hydroxide solution, Cat. No. Baker 3727-01, [1310-73-2]

Dionex sodium acetate, anhydrous (82.0±0.5 grams/1 L $H_20$), Cat. No. 59326, [127-09-3].

Standards

Internal Standards

Fucose is used for the kraft and dissolving pulp Samples. 2-Deoxy-D-glucose is used for the wood pulp Samples.

Fucose, internal standard. 12.00±0.005 g of Fucose, Sigma Cat. No. F 2252, [2438-80-4], is dissolved in 200.0 mL $H_2O$ giving a concentration of 60.00±0.005 mg/mL. This standard is stored in the refrigerator.

2-Deoxy-D-glucose, internal standard. 12.00±0.005 g of 2-Deoxy-D-glucose, Fluka Cat. No. 32948 g [101-77-9] is dissolved in 200.0 mL $H_2O$ giving a concentration of 60.00±0.005 mg/mL. This standard is stored in the refrigerator.

Kraft Pulp Stock Standard Solution

KRAFT PULP SUGAR STANDARD CONCENTRATIONS

| Sugar | Manufacturer | Purity | g/200 mL |
|---|---|---|---|
| Arabinose | Sigma | 99% | 0.070 |
| Galactose | Sigma | 99% | 0.060 |
| Glucose | Sigma | 99% | 4.800 |
| Xylose | Sigma | 99% | 0.640 |
| Mannose | Sigma | 99% | 0.560 |

Kraft Pulp Working Solution

Weigh each sugar separately to 4 significant digits and transfer to the same 200-mL volumetric flask. Dissolve sugars in a small amount of water. Take to volume with water, mix well, and transfer contents to two clean, 4-oz. amber bottles. Label and store in the refrigerator. Make working standards as in the following table.

PULP SUGAR STANDARD CONCENTRATIONS FOR KRAFT PULPS

| Fucose Sugar | mg/mL | mL/200 mL 0.70 ug/mL | mL/200 mL 1.40 ug/mL | mL/200 mL 2.10 ug/mL | mL/200 mL 2.80 ug/mL | mL/200 mL 3.50 ug/mL |
|---|---|---|---|---|---|---|
| Fucose | 60.00 | 300.00 | 300.00 | 300.00 | 300.00 | 300.00 |
| Arabinose | 0.36 | 1.2 | 2.5 | 3.8 | 5.00 | 6.508 |
| Galactose | 0.30 | 1.1 | 2.2 | 3.30 | 4.40 | 5.555 |
| Glucose | 24.0 | 84 | 168.0 | 252.0 | 336.0 | 420.7 |
| Xylose | 3.20 | 11 | 22.0 | 33.80 | 45.00 | 56.05 |
| Mannose | 2.80 | 9.80 | 19.0 | 29.0 | 39.0 | 49.07 |

Dissolving Pulp Stock Standard Solution

DISSOLVING PULP SUGAR STANDARD CONCENTRATIONS

| Sugar | Manufacturer | Purity | g/100 mL |
|---|---|---|---|
| Glucose | Sigma | 99% | 6.40 |
| Xylose | Sigma | 99% | 0.120 |
| Mannose | Sigma | 99% | 0.080 |

Dissolving Pulp Working Solution

Weigh each sugar separately to 4 significant digits and transfer to the same 200-mL volumetric flask. Dissolve sugars in a small amount of water. Take to volume with water, mix well, and transfer contents to two clean, 4-oz. amber bottles. Label and store in the refrigerator. Make working standards as in the following table.

PULP SUGAR STANDARD CONCENTRATIONS FOR DISSOLVING PULPS

| Fucose Sugar | mg/mL | mL/200 mL 0.70 ug/mL | mL/200 mL 1.40 ug/mL | mL/200 mL 2.10 ug/mL | mL/200 mL 2.80 ug/mL | mL/200 mL 3.50 ug/mL |
|---|---|---|---|---|---|---|
| Fucose | 60.00 | 300.00 | 300.00 | 300.00 | 300.00 | 300.00 |
| Glucose | 64.64 | 226.24 | 452.48 | 678.72 | 904.96 | 1131.20 |
| Xylose | 1.266 | 4.43 | 8.86 | 13.29 | 17.72 | 22.16 |
| Mannose | 0.8070 | 2.82 | 5.65 | 8.47 | 11.30 | 14.12 |

Wood Pulp Stock Standard Solution

WOOD PULP SUGAR STANDARD CONCENTRATIONS

| Sugar | Manufacturer | Purity | g/200 mL |
|---|---|---|---|
| Fucose | Sigma | 99% | 12.00 |
| Rhamnose | Sigma | 99% | 0.0701 |

Dispense 1 mL of the fucose solution into a 200-mL flask and bring to final volume. Final concentration will be 0.3 mg/mL.

Wood Pulp Working Solution

Use the Kraft Pulp Stock solution and the fucose and rhamnose stock solutions. Make working standards as in the following table.

PULP SUGAR STANDARD CONCENTRATIONS FOR KRAFT PULPS

| 2-Deoxy-D-glucose Sugar | mg/mL | mL/200 mL 0.70 ug/mL | mL/200 mL 1.40 ug/mL | mL/200 mL 2.10 ug/mL | mL/200 mL 2.80 ug/mL | mL/200 mL 3.50 ug/mL |
|---|---|---|---|---|---|---|
| 2-DG | 60.00 | 300.00 | 300.00 | 300.00 | 300.00 | 300.00 |
| Fucose | 0.300 | 1.05 | 2.10 | 3.15 | 4.20 | 6.50 |
| Arabinose | 0.36 | 1.2 | 2.5 | 3.8 | 5.00 | 6.508 |
| Galactose | 0.30 | 1.1 | 2.2 | 3.30 | 4.40 | 5.555 |
| Rhamnose | 0.3500 | 1.225 | 2.450 | 3.675 | 4.900 | 6.125 |
| Glucose | 24.00 | 84 | 168.0 | 252.0 | 336.0 | 420.7 |
| Xylose | 3.20 | 11 | 22.0 | 33.80 | 45.00 | 56.05 |
| Mannose | 2.80 | 9.80 | 19.0 | 29.0 | 39.0 | 49.07 |

Procedure

Sample Preparation

Grind 0.2±05 g Sample with Wiley Mill 40 Mesh screen size. Transfer ~200 mg of Sample into 40-mL Teflon container and cap. Dry overnight in the vacuum oven at 50° C.

Add 1.0 mL 72% $H_2SO_4$ to test tube with the Brinkman dispenser. Stir and crush with the rounded end of a glass or Teflon stirring rod for one minute. Turn on heat for Gyrotory Water-Bath Shaker. The settings are as follows:

Heat: High

Control Thermostat: 7° C.

Safety thermostat: 25° C.

Speed: Off

Shaker: Off

Place the test tube rack in gyrotory water-bath shaker. Stir each Sample 3 times, once between 20-40 min, again between 40-60 min, and again between 60-80 min. Remove the Sample after 90 min. Dispense 1.00 mL of internal standard (Fucose) into Kraft Samples.

Tightly cover Samples and standard flasks with aluminum foil to be sure that the foil does not come off in the autoclave.

Place a Comply SteriGage Steam Chemical Integrator on the rack in the autoclave. Autoclave for 60 minutes at a pressure of 14-16 psi (95-105 kPa) and temperature >260° F. (127° C.).

Remove the Samples from the autoclave. Cool the Samples. Transfer Samples to the 200-mL volumetric flasks. Add 2-deoxy-D-glucose to wood Samples. Bring the flask to final volume with water.

For Kraft and Dissolving Pulp Samples:

Filter an aliquot of the Sample through GHP 0.45μ filter into a 16-mL amber vial.

For Wood Pulp Samples:

Allow particulates to settle. Draw off approximately 10 mL of Sample from the top, trying not to disturb particles and filter the aliquot of the Sample through GHP 0.45μ filter into a 16-mL amber vial. Transfer the label from the volumetric flask to the vial. Add 1.00 mL aliquot of the filtered Sample with to 8.0 mL of water in the Dionex vial.

Samples are run on the Dionex AS/500 system. See Chromatography procedure below.

Chromatography Procedure

Solvent Preparation

Solvent A is distilled and deionized water (18 meg-ohm), sparged with helium while stirring for a minimum of 20 minutes, before installing under a blanket of helium, which is to be maintained regardless of whether the system is on or off.

Solvent B is 400 mM NaOH. Fill Solvent B bottle to mark with water and sparge with helium while stirring for 20 minutes. Add appropriate amount of 50% NaOH.

(50.0 g NaOH/100 g solution)*(1 mol NaOH/40.0 g NaOH)*(1.53 g solution/1 mL solution)*(1000 mL solution/1 L solution)=19.1 M NaOH in the container of 50/50 w/w NaOH.

0.400 M NaOH*(1000 mL $H_2O$/19.1 M NaOH) 20.8 mL NaOH

Round 20.8 mL down for convenience:

19.1 M*(20.0 mL x mL)=0.400 M NaOH x mL=956 mL

Solvent D is 200 mM sodium acetate. Using 18 meg-ohm water, add approximately 450 mL deionized water to the Dionex sodium acetate container. Replace the top and shake until the contents are completely dissolved. Transfer the sodium acetate solution to a 1-L volumetric flask. Rinse the 500-mL sodium acetate container with approximately 100 mL water, transferring the rinse water into the volumetric flask. Repeat rinse twice. After the rinse, fill the contents of the volumetric flask to the 1-L mark with water. Thoroughly mix the eluent solution. Measure 360±10 mL into a 2-L graduated cylinder. Bring to 1800±10 mL. Filter this into a 2000-mL sidearm flask using the Millipore filtration apparatus with a 0.45 pm, Type HA membrane. Add this to the solvent D bottle and sparge with helium while stirring for 20 minutes.

The postcolumn addition solvent is 300 mM NaOH. This is added postcolumn to enable the detection of sugars as anions at pH>12.3. Transfer 15±0.5 mL of 50% NaOH to a graduated cylinder and bring to 960±10 mL in water.

(50.0 g NaOH/100 g Solution)*(1 mol NaOH/40.0 g NaOH)*(1.53 g Solution/1 mL Solution) (1000 mL Solution/1 L solution)=19.1 M NaOH in the container of 50/50 w/w NaOH.

0.300 M NaOH*(1000 ml H2O/19.1 M NaOH)=15.7 mL NaOH

Round 15.7 mL down:

19.1M*(15.0 mL/x mL)=0.300 M NaOH x mL=956 mL (Round 956 mL to 960 mL. As the pH value in the area of 0.300 M NaOH is steady, an exact 956 mL of water is not necessary.)

Set up the AS 50 schedule.

Injection volume is 5 uL for all Samples, injection type is "Full", cut volume is 10 uL, syringe speed is 3, all Samples and standards are of Sample Type "Sample". Weight and Int. Std. values are all set equal to 1.

Run the five standards at the beginning of the run in the following order:

STANDARD A1 DATE
STANDARD B1 DATE
STANDARD C1 DATE
STANDARD D1 DATE
STANDARD E1 DATE

After the last Sample is run, run the mid-level standard again as a continuing calibration verification Run the control Sample at any Sample spot between the beginning and ending standard runs.

Run the Samples.

Calculations

Calculations for Weight Percent of the Pulp Sugars $$\text{Normalized area for sugar} = \frac{(\text{Area sugar}) * (\mu\text{g/mL fucose})}{(\text{Area Fucose})}$$

*IS* Corrected sugar amount $$\left(\mu\text{g/mL} = \frac{((\text{Normalized area for sugar}) - (\text{intercept}))}{(\text{slope})}\right.$$

$$\text{Monomer Sugar Weight \%} = \frac{IS - \text{Corrected sugar } amt\,(\mu\text{g/mL})}{\text{Sample } wt.\ (\text{mg})} * 20$$

Example for Arabinose:

$$\text{Monomer Sugar Weight \%} = \frac{0.15\ \mu\text{g/mL arabinose}}{70.71\ \text{mg arabinose}} * 20 = 0.043\%$$

Polymer Weight %=(Weight % of Sample sugar)*(0.88)

Example for Arabinan:

Polymer Sugar Weight %=(0.043 wt %)*(0.88)=0.038 Weight

Note, Xylose and arabinose amounts are corrected by 88% and fucose, galactose, rhamnose, glucose, and mannose are corrected by 90%.

Report results as percent sugars on an oven-dried basis.

TABLE 2

Processing And Fiber Properties

| | Control | | | Sample No. | | | | | | | |
|---|---|---|---|---|---|---|---|---|---|---|---|
| | A | B | C | 1 | 2 | 3 | 4 | 5 | 6 | 7 | 8 |
| 97% NMMO g | 66.4 | 66.4 | 66.4 | 66.2 | 66.2 | 66.2 | 66.2 | 66.2 | 66.2 | 66.2 | 66.2 |
| 50% NMMO g | 25.4 | 25.4 | 25.4 | 24.5 | 24.5 | 24.5 | 24.5 | 24.5 | 24.5 | 24.5 | 24.5 |
| Propyl gallate g | 0.1 | 0.1 | 0.1 | 0.1 | 0.1 | 0.1 | 0.1 | 0.1 | 0.1 | 0.1 | 0.1 |
| Pulp DP | 420 | 420 | 420 | 420 | 420 | 420 | 420 | 420 | 420 | 420 | 420 |
| Pulp g | 10.4 | 10.4 | 10.4 | 10.4 | 10.4 | 10.4 | 10.4 | 10.4 | 10.4 | 10.4 | 10.4 |
| SILVIO (5%) (g) | | | | | | | | | | | |
| Cellulose % | 10.18 | 10.18 | 10.18 | 10.29 | 10.29 | 10.29 | 10.29 | 10.29 | 10.29 | 10.29 | 10.29 |
| Additive | no | no | no | PE | PE | PE | PE | PE | PE | PE | PE |
| Additive g | 0 | 0 | 0 | 1 | 1 | 1 | 1 | 2 | 2 | 3 | 3 |
| Wt % additive on pulp | | | | | | | | | | | |
| Wt % additive in fiber | 0.00 | 0.00 | 0.00 | 8.77 | 8.77 | 8.77 | 8.77 | 16.13 | 16.13 | 22.39 | 22.39 |
| Solid (wt %) | 10.18 | 10.18 | 10.18 | 11.17 | 11.17 | 11.17 | 11.17 | 12.03 | 12.03 | 12.87 | 12.87 |
| Air pressure (psi) | 10.00 | 10.00 | 20.00 | 5.00 | 10.00 | 15.00 | 20.00 | 20.00 | 30.00 | 20.00 | 30.00 |
| Diameter (micron) | 17.5 | 19.9 | 8.3 | 35 | 18.1 | 11 | 6 | 14.1 | 13.6 | 14.3 | 12.1 |
| WRV g/g | | 1.75 | | | 1.02 | | | | 1.452 | | 1.284 |
| Xylan | 4.82 | 5.02 | 4.76 | 4.68 | | | | 4.6 | 3.69 | 4.47 | 3.36 |
| Mannan | 4.61 | 4.72 | 4.59 | 4.23 | | | | 3.95 | 3.48 | 3.75 | 3.31 |
| Brightness, ISO | 70 | | | | | | | | 61.3 | | 68.3 |
| Birefrigence | 0.026 | 0.026 | 0.034 | | | 0.03 | 0.034 | 0.026 | 0.026 | 0.024 | 0.028 |

What is claimed is:

1. Meltblown lyocell fibers present in a fiber matrix comprising at least one polyolefinic polymer, wherein said polymer is in domains randomly and uniformly distributed throughout the lyocell fibers present in the fiber matrix, wherein said polymer has an acid number <8 mg KOH/g, and wherein said polymer has a weight average molecular weight of less than 50,000.

2. The fibers of claim 1 wherein said polymer has an acid number <5 mg KOH/g.

3. The fibers of claim 1 wherein said polymer has an acid number <1 mg KOH/g.

4. The fibers of claim 1 wherein the polymer is selected from the group consisting of polyethylene, modified polyethylene, polypropylene, modified polypropylene, and mixtures thereof.

5. The fibers of claim 4 wherein the polymer is polyethylene.

6. The fibers of claim 1 wherein the lyocell fibers further comprise paraffin wax in domains randomly and uniformly distributed throughout the lyocell fibers.

7. The fibers of claim 1 wherein the birefringence is at least 0.015.

8. The fibers of claim 1 wherein the fiber diameter is from 2 to 50 microns.

9. The fibers of claim 1 wherein the water retention value is decreased at least ten percent from a control having no polymer.

* * * * *